US008726615B2

(12) United States Patent
Desrues

(10) Patent No.: US 8,726,615 B2
(45) Date of Patent: May 20, 2014

(54) METHOD FOR CONDITIONING A FLUID PRODUCT IN A DISPENSER

(75) Inventor: Stéphane Desrues, Thuit-Signol (FR)

(73) Assignee: Aptar France SAS, Le Neuboug (FR)

( * ) Notice: Subject to any disclaimer, the term of this patent is extended or adjusted under 35 U.S.C. 154(b) by 577 days.

(21) Appl. No.: 13/002,268

(22) PCT Filed: Jun. 30, 2009

(86) PCT No.: PCT/FR2009/051262

§ 371 (c)(1),
(2), (4) Date: Dec. 30, 2010

(87) PCT Pub. No.: WO2010/001049

PCT Pub. Date: Jan. 7, 2010

(65) Prior Publication Data

US 2011/0146207 A1 Jun. 23, 2011

(30) Foreign Application Priority Data

Jul. 1, 2008 (FR) ..... 08 54438

(51) Int. Cl.
*B65B 31/02* (2006.01)

(52) U.S. Cl.
CPC ..... *B65B 31/025* (2013.01)
USPC ..... 53/410; 53/420; 53/432; 53/471

(58) Field of Classification Search
USPC ..... 53/410, 428, 432, 510, 420, 471, 485, 53/133.1, 133.2, 270, 281
See application file for complete search history.

(56) References Cited

U.S. PATENT DOCUMENTS

| | | | | | |
|---|---|---|---|---|---|
| 2,054,492 | A * | 9/1936 | Young | 53/432 |
| 2,973,609 | A * | 3/1961 | Morgan, Jr. | 53/510 |
| 3,336,720 | A * | 8/1967 | Honisch | 53/510 |
| 4,848,419 | A * | 7/1989 | Damen | 53/510 |
| 5,217,050 | A * | 6/1993 | Varlet | 141/2 |
| 5,237,797 | A * | 8/1993 | Varlet | 53/420 |
| 6,345,739 | B1 * | 2/2002 | Mekata | 222/389 |
| 6,457,299 | B1 | 10/2002 | Schwenke et al. | |

(Continued)

FOREIGN PATENT DOCUMENTS

| | | |
|---|---|---|
| DE | 19817735 C1 | 11/1999 |
| EP | 0446513 A1 | 9/1991 |

(Continued)

*Primary Examiner* — Stephen F Gerrity
(74) *Attorney, Agent, or Firm* — Sughrue Mion, PLLC

(57) ABSTRACT

A packaging method for packaging fluid (P) in a fluid dispenser comprising a fluid reservoir (1) defining an opening (13), and a fluid dispenser member (2), such as a pump or a valve, for mounting in leaktight manner on the opening (13) of the reservoir, an inert gas, such as nitrogen or argon, being present in the reservoir above the fluid (P) while the dispenser member (2) is being mounted in leaktight manner on the opening (13) of the reservoir, such that the fluid (P) is in contact with the inert gas in the reservoir (1); the method being characterized in that the step of mounting the dispenser member (2) in leaktight manner on the opening (13) of the reservoir (1) is performed under a vacuum, the inert gas is evacuated, at least in part, from the reservoir during this evacuation step, such that the reservoir is subjected to an inert-gas vacuum.

8 Claims, 1 Drawing Sheet

(56) References Cited

U.S. PATENT DOCUMENTS

Figure 2:
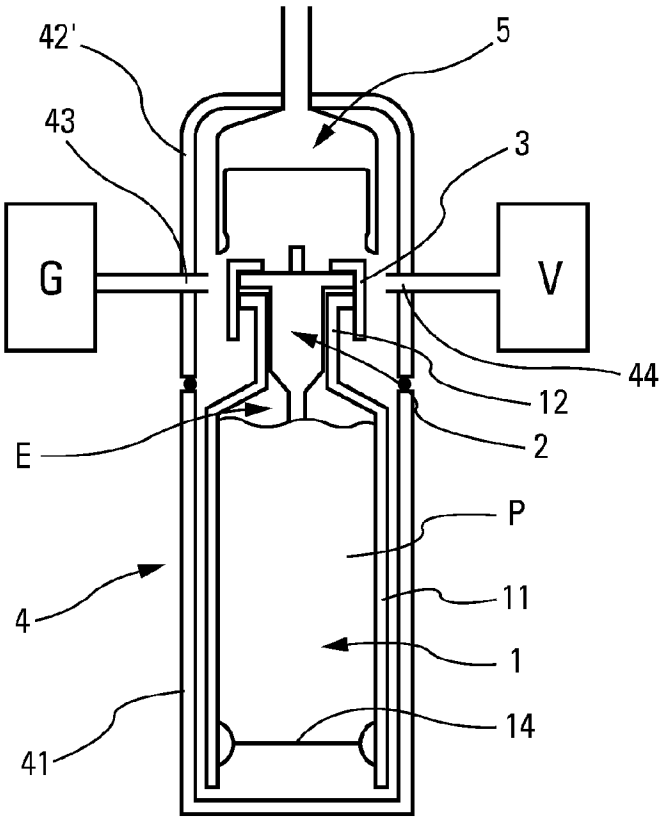

| | | | | |
|---|---|---|---|---|
| 6,694,709 | B2 * | 2/2004 | Takahashi et al. | 53/510 |
| 7,124,788 | B2 * | 10/2006 | Pericard | 141/20 |
| 2006/0054634 | A1 * | 3/2006 | Mekata | 222/94 |
| 2007/0062162 | A1 * | 3/2007 | Lehmann | 53/432 |
| 2007/0241132 | A1 * | 10/2007 | Smith | 222/95 |
| 2008/0185067 | A1 * | 8/2008 | Lim et al. | 141/3 |

FOREIGN PATENT DOCUMENTS

| | | | | |
|---|---|---|---|---|
| EP | 0481854 | A1 | 4/1992 | |
| EP | 0509179 | A1 | 10/1992 | |
| FR | 2582509 | A * | 12/1986 | B65B 31/00 |
| FR | 2704516 | A1 | 11/1994 | |
| GB | 2110771 | A | 6/1983 | |
| GB | 2218078 | A | 11/1989 | |

* cited by examiner

METHOD FOR CONDITIONING A FLUID PRODUCT IN A DISPENSER

CROSS REFERENCE TO RELATED APPLICATIONS

This application is a National Stage of International Application No. PCT/FR2009/051262 filed Jun. 30, 2009, which claims priority from French Patent Application No. 0854438 filed Jul. 1, 2008, the contents of all of which are incorporated herein by reference in their entirety.

The present invention relates to a packaging method for packaging fluid in a fluid dispenser that comprises a fluid-filled reservoir defining an opening, and a fluid dispenser member, such as a pump or a valve. The dispenser member is for mounting in leaktight manner on the opening of the reservoir, thereby constituting the fluid dispenser. This type of dispenser is frequently used in the fields of cosmetics, perfumery, or even pharmacy for packaging various fluids, such as fragrances, creams, gels, lotions, or even powders.

Some fluids, very particularly in the fields of cosmetics and pharmacy, are likely to spoil when they are in contact with the air. For example, they may dry out or oxidize. In order to preserve the qualities of the fluid, it is already known to vacuum pack the fluid in the fluid dispenser. In the prior art, documents EP-0 509 179 and EP-0 481 854 are known, for example. Those documents describe methods of filling and sealing under a vacuum. To do that, a vacuum chamber is used in which there is disposed the reservoir, and/or the dispenser member for sealing on the reservoir. In the filling method, the vacuum chamber contains only the reservoir, and fluid is injected into the reservoir while a vacuum exists inside the chamber. This guarantees that no air is introduced into the fluid. In particular, the introduction of air may occur with viscous fluids, such as creams or gels. In the vacuum-sealing method, the fluid-filled reservoir and the fluid dispenser member are disposed inside the vacuum chamber, however the dispenser member is not yet fastened in leaktight manner on the opening of the reservoir. Once the vacuum has been established inside the chamber, sealing equipment acts on the dispenser member so as to mount it in leaktight manner on the opening of the reservoir. Once the vacuum has been established inside the chamber, sealing equipment acts on the dispenser member so as to mount it in leaktight manner on the opening of the reservoir. This ensures that the space inside the reservoir that is not filled with fluid contains little air, if any. Document FR 2 704 516 describes such prior art, on which the preamble of the main claim is based.

However, it should be noted that the small amount of air that remains inside the reservoir above the fluid is also capable of spoiling some fluids. It may thus be concluded that vacuum filling or sealing is not sufficient to guarantee complete preservation of the fluid stored inside the reservoir.

An object of the present invention is to remedy the above-mentioned drawback of the prior art by defining a novel packaging method that may be implemented in place of, or in addition to, vacuum filling and sealing methods of the prior art.

To achieve this object, the present invention proposes a packaging method for packaging fluid in a fluid dispenser comprising a fluid reservoir defining an opening, and a fluid dispenser member, such as a pump or a valve, for mounting in leaktight manner on the opening of the reservoir, an inert gas, such as nitrogen or argon, being present in the reservoir above the fluid while the dispenser member is being mounted in leaktight manner on the opening of the reservoir, such that the fluid is in contact with the inert gas in the reservoir; the method being characterized in that the step of mounting the dispenser member in leaktight manner on the opening of the reservoir is performed under a vacuum, the inert gas is evacuated, at least in part, from the reservoir during this evacuation step, such that the reservoir is subjected to an inert-gas vacuum. This is the preferred embodiment that guarantees that there is no air inside the reservoir. In practice, the air initially contained in the reservoir is evacuated, then replaced by an inert gas, and then the inert gas is evacuated from the reservoir, and the dispenser member is mounted in leaktight manner on the opening of the reservoir. This guarantees that there is no air and very little inert gas inside the reservoir. The fluid is thus best preserved. The term "inert gas" should be understood to mean any gas that does not react with the fluid in such a manner as to spoil it. Nitrogen and argon are common gases that are known for their chemical inertness. Thus, the air that is normally contained in the reservoir, in normal quantity or in small quantity following a packaging method under a vacuum, is replaced by an inert gas. As a result, complete preservation of the fluid is guaranteed.

In an embodiment, the air initially contained in the reservoir is expelled, e.g. by suction, then the inert gas is allowed to penetrate into the reservoir in place of the air. In a variant, it is possible to expel the air from the reservoir with the inert gas. In the context of the invention, it is not necessary to create a vacuum when the dispenser member is mounted in leaktight manner on the opening of the reservoir. Thus, the dispenser member may be filled with fluid and/or sealed on the reservoir at atmospheric pressure with the inert gas inside the reservoir above the fluid.

However, in an advantageous embodiment, the packaging method of the invention may include a step of filling the reservoir with fluid, the air being replaced by the inert gas prior to and/or after the filling step. Advantageously, the filling step is performed under an air or an inert-gas vacuum, the reservoir being returned to atmospheric pressure by allowing the inert gas into the reservoir. The purge is performed with an inert gas at a pressure that is at least equal to atmospheric pressure, thereby making it possible to guarantee that the fluid does not come into contact with air. By using a gas that is heavier than air, such as argon for example, the inert gas may remain inside the reservoir above the fluid even at atmospheric pressure. The reservoir filled in this way with fluid and with inert gas may pass to the following station in which the dispenser member is mounted in leaktight manner on the reservoir, this operation possibly being performed at atmospheric pressure. Naturally, it is preferable to evacuate the gas prior to mounting, especially when the reservoir is an airless reservoir that should contain only fluid.

The spirit of the invention resides in performing at least some fluid packaging operations in an inert-gas atmosphere at least in the reservoir, so that, after packaging, the fluid is not in contact with air, but in contact with an inert gas that does not interact with the fluid and thus guarantees its complete preservation.

The invention is described more fully below with reference to the accompanying drawing which shows two implementations of the present invention by way of non-limiting example.

Figure 1:
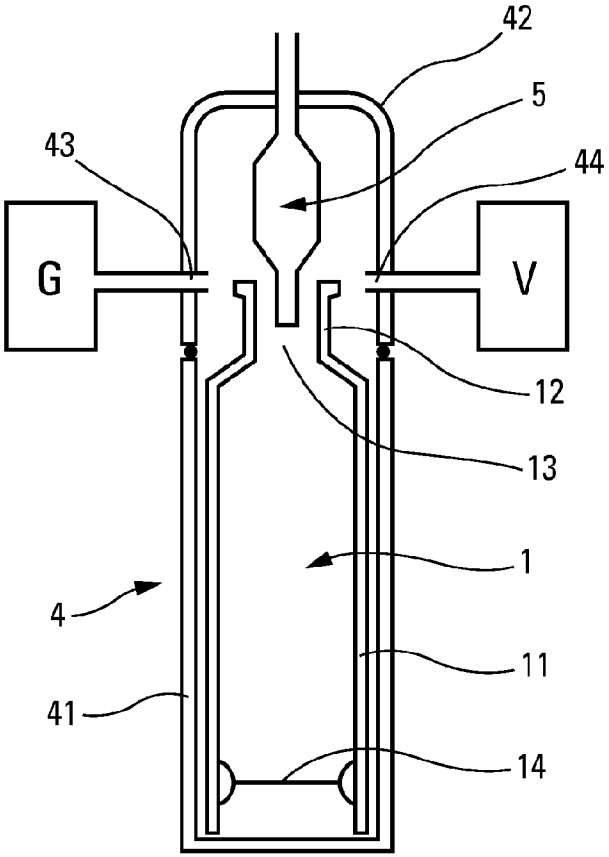

In the figures:

FIG. 1 is a diagrammatic vertical section view through a fluid-packaging device that is capable of implementing the fluid-packaging method of the invention during a filling operation; and FIG. 2 is a view similar to the view in FIG. 1 during an operation of mounting the dispenser member on the fluid-filled reservoir, or of sealing it in leaktight manner thereon.

The present invention consists in a packaging method that is implemented by means of an appropriate packaging device for the purpose of making a fluid dispenser that incorporates the results of the packaging method. The two packaging devices shown in FIGS. 1 and 2 are very similar in that each of them comprises a vacuum chamber 4, an inert-gas inlet 43 that is connected to an inert-gas source G, an outlet 44 that is connected to a vacuum pump V for evacuating the chamber 4, and a filling station 5 or a leaktight-mounting station 6. The chamber 4 comprises a bottom cup 41 and a top bell 42 or 42' that are fitted one on the other in leaktight manner so as to create an inside space in which a vacuum may be formed. The inert-gas inlet 43 and the outlet 44 are situated in the bell 42, 42'. In the first embodiment in FIG. 1, the bell 42 is fitted with a filling station 5 by means of which fluid P may be injected into the bell. In the second embodiment in FIG. 2, the bell 42' is fitted with a leaktight-mounting station 6 that may be a crimping or snap-fastening station, for example.

The packaging method and the packaging devices of the invention are for packaging fluid P in a fluid dispenser that includes, amongst other things, a fluid reservoir and a dispenser member, such as a pump or a valve, for mounting in leaktight manner on the reservoir. As mentioned above, the dispenser member may be of any kind, and consequently is not limited only to a pump or a valve. The reservoir may also be of any kind, of constant or variable capacity, of rigid or deformable nature, or even including a movable element in order to vary its capacity. In view of the object of the present invention, namely complete preservation of the fluid inside the reservoir, naturally it is preferable that the quantity of fluid extracted from the reservoir is not replaced by an equivalent volume of outside air. As a result, it is preferable to use variable-capacity reservoirs such as deformable reservoirs of the flexible-pouch type, or movable-wall reservoirs of the follower-piston reservoir type. In FIGS. 1 and 2, the reservoir 1 is of the follower-piston type. More precisely, the reservoir 1 includes a slide cylinder 11 that extends to form a neck 12 that internally defines an opening 13 that puts the inside of the cylinder 11 into communication with the outside. The reservoir 1 also includes a follower-piston 14 that is engaged to slide in leaktight manner inside the cylinder 11. The follower-piston 14 is for moving inside the cylinder 11 as fluid is extracted therefrom. Movement of the follower-piston 14 is generated by suction created inside the reservoir. All of this is entirely conventional for this type of follower-piston reservoir.

The dispenser member 2 is shown only in FIG. 2. A fastener ring 3 that is shown only very diagrammatically is used to fasten the dispenser member or to mount it in leaktight manner on the neck 12 of the reservoir 1. The fastener ring may be a crimping ring or even a snap-fastening ring. It is even possible to use a screw-fastening ring. The essential point is that the ring 3 secures the pump 2 in leaktight manner on the neck 12 of the reservoir.

Reference is made below more particularly to FIG. 1 in order to explain a first implementation of the fluid-packaging method of the invention during a filling operation of the reservoir. In this configuration, the reservoir 1 is inserted into the cup 41 of the chamber 4, and the bell 42 comes to complete the chamber 4 so as to isolate the inside of the chamber 4 from the outside. Thus, the inside of the reservoir 1 and the outside of the reservoir are subjected to the same pressure that exists inside the chamber 4. The filling station 5 extends inside the bell 42 in such a manner as to penetrate, at least in part, into the neck 12 so as to be able to inject fluid into the reservoir.

In an aspect of the invention, prior to beginning the filling operation, the air that is present inside the chamber 4 is evacuated through the outlet 44 that is connected to the vacuum pump V. Thus, an air vacuum exists inside the chamber 4. As a function of the strength of the vacuum, air remains to a greater or lesser extent inside the chamber 4: evacuation may tend towards 100%. Then, an inert gas is introduced into the chamber 4 through the inlet 43 that is connected to the inert-gas source G. Given that an air vacuum exists inside the chamber 4, it suffices to allow the inert gas inside the chamber G to penetrate through the inlet 43. In a variant, it is also possible to expel the air initially contained in the chamber 4 through the outlet 44 directly towards the atmosphere, without being connected to the pump V, by injecting inert gas under pressure into the chamber through the inlet 43. This technique has the advantage of replacing the air with the inert gas in a single step, and not in two steps, as when the chamber 4 is emptied initially, and then filled with inert gas. Naturally, either way, the chamber 4 is filled with inert gas, and no longer with air. In practice, it is impossible to eliminate all of the air in the chamber 4, but its proportion relative to the gas is reduced to as little as possible. Thus, when the chamber 4 is filled with inert gas, the fluid-filling operation by means of the station 5 may begin. Thus, it is guaranteed that no air is introduced into the fluid contained in the reservoir. At worst, gas is introduced, but said gas is not detrimental to the fluid.

In another aspect of the invention, the filling operation may be performed under a vacuum, but the vacuum is not an air vacuum, but an inert-gas vacuum. Once the chamber 4 has been filled with inert gas, the chamber may be evacuated by means of the vacuum pump V, through the outlet 44. Thus, the chamber is emptied of some or all of its content, which content is inert gas. The filling operation may then begin under this inert-gas vacuum. Once filling has terminated, it is guaranteed that no bubble of inert gas has been introduced into the fluid stored inside the reservoir. The inert-gas vacuum may be broken, and the chamber 4 may then be opened by moving the cup 41 relative to the bell 42. The reservoir is then at atmospheric pressure and/or in ambient air, depending on whether or not a vacuum has been created in the chamber. When the reservoir has been filled in an inert-gas atmosphere that is substantially at atmospheric pressure, opening the chamber 4 allows the inert gas to disperse into the atmosphere. However, by selecting an inert gas that is substantially heavy, such as argon, the fluid-free space inside the reservoir above the fluid may remain filled with inert gas. Then, during a subsequent leaktight-mounting step, it suffices to mount the dispenser member 2 in leaktight manner in the opening of the reservoir 12. Thus, the fluid-free space inside the reservoir is filled mainly with inert gas. Thus, it is possible to implement the present invention without evacuation.

In a variant, when the filling operation has been performed under a vacuum, opening the chamber 4 causes air to be introduced into the reservoir 1 above the fluid. In this configuration, it is preferable to perform the operation of mounting the dispenser member in leaktight manner on the reservoir under vacuum conditions.

In a preferred variant, inert gas may be introduced into the reservoir after the filling operation, which has been performed at atmospheric pressure. It is necessary to purge with an inert gas, thereby guaranteeing that the filled fluid is completely protected.

Reference is thus made below to FIG. 2 in which the packaging method of the invention is implemented during an operation of mounting the dispenser member in leaktight manner on the opening of the reservoir. A complete fluid dispenser is inserted into the chamber 4. The dispenser includes a reservoir 1, like the FIG. 1 reservoir, and a dispenser member 2 that is disposed in non-leaktight manner in the opening 12 of the reservoir. The dispenser also includes a fastener ring 3 that is mounted in non-permanent manner, and consequently in non-leaktight manner, on the dispenser member 2. The reservoir 1 is filled with fluid P up to a level that is close to the opening 12. However, there exists a space E that is free of fluid, and consequently said space is filled with air initially. The chamber is closed: however, the space E is subjected to the same pressure as the pressure that exists in the remainder of the chamber outside the reservoir, given that there is no sealing between the dispenser member 2 and the reservoir.

In an aspect of the invention, the air initially contained inside the chamber 4 is replaced by an inert gas. This operation may be performed in the same way as in the first implementation in FIG. 1. The air inside the chamber may be evacuated through the outlet 44 by means of the vacuum pump V, then inert gas may be introduced into the air-free chamber 4 through the inlet 43 that is connected to the gas source G. In a variant, the air contained inside the chamber 4 may be expelled by injecting inert gas under pressure into the chamber. The air is expelled or evacuated through the outlet 44 that opens directly to the atmosphere. Either way, the result is a chamber 4 that is filled with inert gas. Consequently, the space E is filled with inert gas.

It is preferable for the space E to be filled with inert gas prior to closing the chamber, since it is difficult to evacuate said space, and to fill it correctly with the pump mounted on the flask, even when it is mounted in non-leaktight manner.

It is then possible to put the leaktight-mounting station 6 into operation so as to mount the dispenser member 2 in leaktight manner on the neck 12 by means of the ring 3. Finally, a complete leaktight fluid dispenser is obtained with the space E filled with inert gas. This implementation is not applicable to airless dispensers that require a reservoir that is filled completely with fluid.

In a preferred variant, once again it is possible to evacuate the chamber 4 through the outlet 44 by means of the vacuum pump V so as to cause an inert-gas vacuum to exist inside the chamber 4. Naturally, the inert-gas vacuum extends as far as the space E. The leaktight-mounting station 6 may then be implemented so as to mount the dispenser member 2 in leaktight manner on the neck 12 of the reservoir by means of the ring 3. The space E that is also subjected to the inert-gas vacuum contains only a small amount of gas. By returning the chamber 4 to atmospheric pressure, the space E decreases considerably because of the follower-piston 4 rising inside the cylinder 11. However, there nevertheless exists a small space E that is filled with inert gas, and not with air. This implementation is particularly appropriate for airless dispensers.

The packaging methods of the invention shown in FIGS. 1 and 2 may be implemented successively or independently of each other. The filling operation and/or the leaktight-mounting operation may optionally be performed under a vacuum. If inert gas remains above the fluid inside the reservoir 1 after the filling operation, the mounting operation may be performed at atmospheric pressure. However, this is used rarely since the operation of the dispenser is not optimized, in particular for airless dispensers.

Finally, a fluid dispenser is obtained having a reservoir that is filled almost completely with fluid, but that still however contains a small fluid-free portion or space that is filled with inert gas.

The invention claimed is:

1. A packaging method for packaging fluid in a fluid dispenser comprising a fluid reservoir defining an opening, and a fluid dispenser member for mounting in leaktight manner on the opening of the reservoir, an inert gas being present in the reservoir above the fluid while the dispenser member is being mounted in leaktight manner on the opening of the reservoir, such that the fluid is in contact with the inert gas in the reservoir;

wherein the step of mounting the dispenser member in leaktight manner on the opening of the reservoir is performed under a vacuum, the inert gas is evacuated, at least in part, from the reservoir during this evacuation step, such that the reservoir is subjected to an inert-gas vacuum.

2. A packaging method according to claim 1, including expelling the air from the reservoir, then allowing the inert gas to penetrate into the reservoir.

3. A packaging method according to claim 1, including expelling the air from the reservoir with the inert gas.

4. A packaging method according to claim 1, including a step of filling the reservoir with fluid, the air being replaced by the inert gas prior to the filling step.

5. A packaging method according to claim 1, including a step of filling the reservoir with fluid, the air being replaced by the inert gas after the filling step.

6. A packaging method according to claim 5, wherein the filling step is performed under an air or an inert gas vacuum, the reservoir being returned to atmospheric pressure by allowing the inert gas into the reservoir.

7. The packaging method according to claim 1, wherein the fluid dispenser member is a pump or a valve.

8. The packaging method according to claim 1, wherein the inert gas is nitrogen or argon.

* * * * *